US005213239A

United States Patent [19]

Macaluso

[11] Patent Number: 5,213,239

[45] Date of Patent: May 25, 1993

[54] NO SPLATTER NO MESS SPOUT FOR A PAINTCAN

[76] Inventor: Salvatore Macaluso, 29 S. Howell Ave., Farmingville, N.Y. 11738

[21] Appl. No.: 813,574

[22] Filed: Dec. 26, 1991

[51] Int. Cl.[5] ..... B65D 25/00

[52] U.S. Cl. ..... 222/570; 222/567

[58] Field of Search ..... 222/567, 569, 570, 461; 220/287, 306, 307, 733, 700, 701, 702

[56] References Cited

U.S. PATENT DOCUMENTS

| | | | |
|---|---|---|---|
| 2,731,178 | 1/1956 | Larsson | 222/567 |
| 2,802,609 | 8/1957 | Donovan | 222/570 |
| 3,102,667 | 9/1963 | Ullevig | 222/569 |
| 3,252,635 | 5/1966 | Rosenhan | 222/570 |
| 3,309,000 | 4/1967 | Haverstick | 222/570 |
| 3,599,846 | 8/1971 | Stephenson | 222/553 |
| 3,899,107 | 8/1975 | Gaah | 222/570 |
| 3,994,424 | 11/1976 | Koeller | 222/570 |
| 4,020,968 | 5/1977 | Chiavola et al. | 222/570 X |
| 4,054,205 | 10/1977 | Blow, Jr. et al. | 222/570 X |
| 4,316,560 | 2/1982 | Carter | 222/567 |
| 4,369,890 | 1/1983 | Bennett | 222/570 X |
| 4,583,666 | 4/1986 | Buck | 222/570 X |
| 4,813,579 | 3/1989 | Ciumaga | 222/570 |
| 4,893,723 | 1/1990 | SeaBolt | 222/570 X |
| 4,907,714 | 3/1990 | Gatz | 222/570 X |
| 4,911,139 | 3/1990 | DeJean | 222/570 X |
| 4,949,884 | 8/1990 | Dahl | 222/570 |
| 5,031,804 | 7/1991 | Conrad | 222/569 X |

FOREIGN PATENT DOCUMENTS

| | | | |
|---|---|---|---|
| 0931398 | 8/1955 | Fed. Rep. of Germany | 220/700 |
| 2205309 | 12/1988 | United Kingdom | 222/570 |

*Primary Examiner*—Andres Kashnikow
*Assistant Examiner*—A. Pomrening
*Attorney, Agent, or Firm*—Galgano & Belkin

[57] ABSTRACT

In combination, a can of paint having a top opening, the opening being bounded by a bead formed into a circle, a hollow frusto-conical member with top and bottom openings and the bottom opening smaller than the top opening, the member being force fit into the opening with the bottom opening within the can, the member being made from a rigid thermoplastic material with the wall being crushed by the force fit thereby forming a liquid tight fit with the bead.

7 Claims, 1 Drawing Sheet

FIG. 1
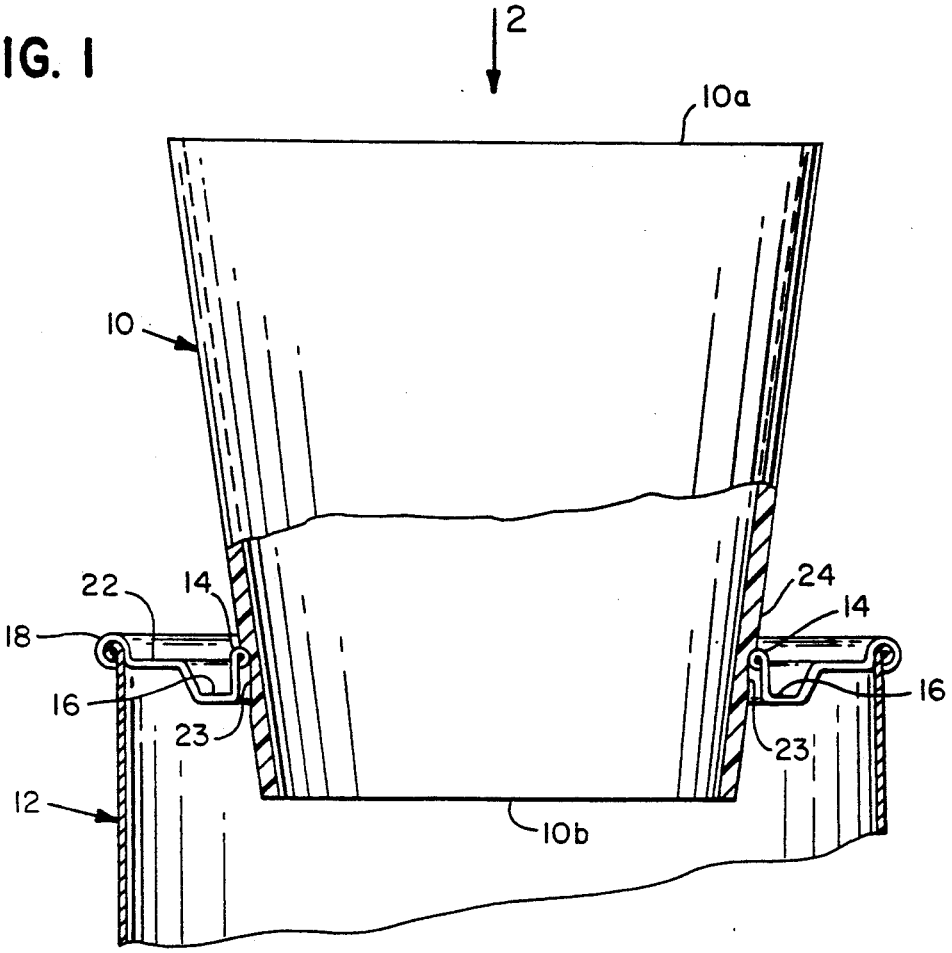
FIG. 2
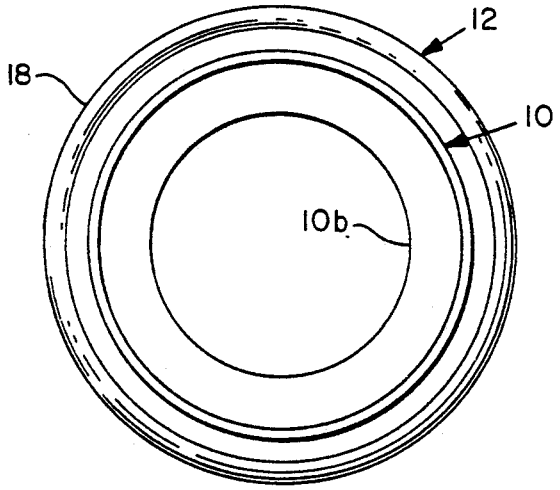
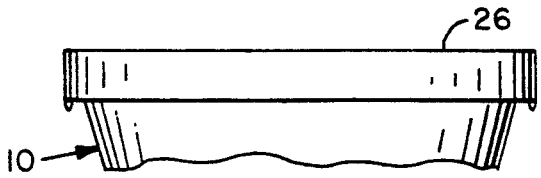
FIG. 3

NO SPLATTER NO MESS SPOUT FOR A PAINTCAN

BACKGROUND OF THE INVENTION

The present invention relates to a spout for use with a paint can and more particularly to a spout or funnel which eliminates or reduces the amount of splattering of paint when removed from the can.

Presently available attachments for use with paint cans designed to avoid splattering of the paint during removal of the paint suffer a variety of disadvantages.

Some of them are complicated and expensive while others are designed to fit only certain size openings. Since there are no standard size openings in paint cans, different companies make different size openings, and the openings also differ with the capacity of the cans. Many such attachments are very limited in their application, and also require tools for their installation and removal.

In addition, many of the devices offered for use do not provide leak proof fitting with the opening in the paint can which severely limits the usefulness of such devices.

Another drawback of paint can attachments now known is their inability to accomodate variations in the shape of the can openings. While nominally the openings in paint cans are circular, it appears that it is not uncommon, and in fact is more apt to be the usual case, that the openings are out of round. Many current designs will not accomodate such variations.

A number of United States Patents have been issued covering such attachments.

U.S. Pat. No. 2,802,609 discloses a pouring attachment which engages the lip of a paint can.

U.S. Pat. No. 3,252,635 shows an extension collar for use on a paint can employing an extension collar.

U.S. Pat. No. 3,309,000 describes a can extender and pourer which is customized to a particular size and shape of the paint can.

U.S. Pat. No. 3,899,107 shows a paint can adaptor which also is configured to fit a certain size and shape paint can.

U.S. Pat. No. 4,020,968 illustrates a container rim guard and extension device which likewise is limited to use for a certain size and shaped can opening.

U.S. Pat. No. 3,994,424 discloses a can guard using a straight down extension which limits the device to only a certain size opening.

U.S. Pat. No. 4,054,205 shows an attachment for a beverage can limited to a certain size and construction.

U.S. Pat. No. 4,369,890 shows a paint can collar with a lower lip with a variable diameter which presumably will adjust to a range of size openings.

U.S. Pat. No. 4,583,666 discloses a container attachment which has an elaborate configuration which apparently will fit only a certain size and shaped container.

U.S. Pat. No. 4,813,579 describes a paint can pouring spout which a locking member which limits its usefulness.

U.S. Pat. No. 4,893,723 shows a paint can attachment which effectively takes the place of the cover and includes various pouring and other features.

U.S. Pat. No. 4,911,319 shows a paint can attachment which is limited to a certain size can.

U.S. Pat. No. 4,949,884 discloses a paint can lid with a pour spout and apparently is designed to replace the lid now in use.

SUMMARY OF THE INVENTION

In the present invention there is provided a spout or funnel attachment for use on paint cans which is simple and economic in construction and installation, is sufficiently inexpensive to be disposable, capable of fitting a large range of can openings, and can accomodate openings which are out of round.

A preferred embodiment of this invention comprises a frustum or frusto-conical member made of a readily crushable, thermoplastic foam material mounted in the opening of a paint can, said member being sufficiently forced in to partially crush the material adjacent the edge in which contact is made, forming a liquid tight seal.

This invention solves most if not all of the problems associated with spouts currently designed for use with paint cans. It is both disposable and reusable, does not require the use of a tool to install and remove, and yet produces a liquid tight seal around the opening of the can. It can be made impervious to some corrosive paints by merely painting the surface with a water based paint. Yet the device is highly effective to permit pouring, mixing in the can, and use of a brush without any splattering taking place in and around the paint can.

It is thus a principal object of this invention to provide a spout for use on a paint can which is highly effective and yet inexpensive to make and easy to use.

Other objects of this invention will become obvious from the following description of preferred embodiments of this invention.

BRIEF DESCRIPTION OF THE FIGURES

FIG. 1 is an elevation view in partial cross section of an open paint can with a preferred embodiment of this invention mounted.

FIG. 2 is a top view of the arrangement shown in FIG. 1.

FIG. 3 is an elevation view of the top of the spout with the paint can cover in place.

DESCRIPTION OF THE PREFERRED EMBODIMENTS

Referring to FIGS. 1 and 2, there is illustrated a frustum or frusto-conical shaped spout or funnel 10 mounted in an open paint can 12 and embodying the principles of this invention.

Can 12 is cylindrical in configuration with a bead 14 defining the circular opening into can 12. Behind bead 14 as is customary for paint can design is an annular channel 16 surrounded by a raised circular rim 18 and a shoulder 22 separating channel 16 and rim 18.

As is understood in the art, paint can 12 is purchased full of paint and the lid (not shown in FIGS. 1 and 2) is removed. One of the problems associated with this kind of paint can design is the accumulation of paint on shoulder 22 and channel 16 making it difficult in many cases to properly reclose the can. In addition, it is understood that when a brush is dipped into the paint within the can and removed some splattering of paint on the outside of the can and the surrounding area is likely to take place.

Spout 10, with a top opening **10*a* and a lower opening 10*b*, is a frustum or of frusto-conical shape, and is constructed from a rigid thermoplastic foam having a crushable wall, a good example being foamed polystyrene or styrofoam. That is, the wall of spout 10** will crush under pressure in a manner to be described below.

Referring to FIG. 1 in particular, it will be seen that when spout 10 is pushed down into the opening formed by bead 14, bead 14 will crush inwardly the wall of spout 10 where contact is made, forming a partially collapsed section 23 which is cylindrical and forming a slightly overlapping bulb 24 which overlaps the top of bead 14. The material does not have a memory so that when spout 10 is removed the wall will retain its crushed shape and not return to its original shape.

This crushing action and the subsequent formation of the overlapping bulb 24 accomplishes the goals of insuring that spout 10 will remain firmly connected to paint pail 10 even if paint is poured out from the top of spout 10 and also insures that a leak tight fit is formed. This is of special importance because as mentioned earlier it has been found that the opening formed by bead 18 is often out of round, and without the permanent deformation which takes place, leaking may occur. In fact, it has been found that the fit is so effective that paint can be added to the can up to the top of spout 10 without leaking around bead 18.

It will be seen also that by adjusting the length and slope of spout 10 it is possible to accomodate a range of sizes of paint can 12 avoiding the need to market spouts of different sizes, thereby avoiding the problem on non-standardized can openings which is so common in the industry.

One of the features of this invention is that if spout 10 is selected with its top opening 10*a* the same as the opening into can 12, as seen in FIG. 3, cover 26 of can 12 can be placed on top of spout 10 to cover the opening and the can of paint can be stored with spout 10 in place. Also, since many paint cans come with plastic covers, such a cover could be used to top opening of spout 10 if of the proper size.

It has been found that spout 10 can be used with some oil base paint which are capable of penetrating the wall of spout 10 by first painting the walls of spout 10 with a water base paint and permitting the paint to dry. This will not sacrifice the usefulness of spout 10.

While only certain preferred embodiments of this invention have been described it is understood that many variations of this invention are possible without departing from the principles of this invention as defined in the claims which follow.

What is claimed is:

1. In combination, a can of paint having a top opening, said opening being bounded by a bead formed into a circle, a wall formed into a disposable hollow frusto-conical member with top and bottom openings and the bottom opening smaller than the top opening of the member, said member being force fit into said paint can top opening with said bottom opening within said can, said member being made from a rigid readily crushable expanded foam material with said wall being crushed by said force fit thereby forming a liquid tight fit with said bead.

2. The combination of claim 1 in which said paint can is provided with a cover which has been removed in order to mount said member in said can, said member having its top opening designed and sized to accommodate said paint can cover, the latter being mounted on the top opening of said member for storing said can of paint without removing said member.

3. The combination of claim 1 in which said member is coated with a water base paint to permit said member to be used with corrosive paint.

4. The combination of claim 1 in which said material is polystyrene.

5. The method of employing a can of paint having a top opening with a cover, said opening being bounded by a bead formed into a circle, a wall formed into a disposable, hollow frusto-conical member with a narrow bottom end and top and bottom openings and the bottom opening being smaller than the top opening of the member, the wall of said member being made from a rigid, readily crushable expanded foam material, said method comprising the steps of removing the cover from said can of paint, inserting the narrow bottom end of said hollow frusto-conical member into the opening of said can of paint with sufficient force to partially crush the wall and to form a slightly overlapping bulb which overlaps the top of said bead so that there is formed a liquid tight fit where the bead of said can of paint contacts and crushes said wall, the member being sufficiently tightly joined to said can of paint to permit pouring paint out of said can through said member while joined to said can of paint, and disposing of said member after use.

6. The method of claim 5 in which the top opening of said member is designed and sized to accommodate said paint can cover, said method having the additional step of closing off the top opening of said member by placing the cover from said can of paint on the top opening of said member.

7. The method of claim 5 in which the outside of said member is painted with a water based paint to permit its use with a can containing an oil based paint.

* * * * *